United States Patent [19]

Gough

[11] Patent Number: 4,551,180

[45] Date of Patent: Nov. 5, 1985

[54] CLEANING ELONGATE STRIP BY DIE IMPACTION

[76] Inventor: Peter R. Gough, 3 Hopstone Gardens, Penn, Wolverhampton, West Midlands, England

[21] Appl. No.: 599,001

[22] Filed: Apr. 11, 1984

[51] Int. Cl.[4] ..... B08B 7/02

[52] U.S. Cl. ..... 134/9; 134/32

[58] Field of Search ..... 134/1, 9, 15, 16, 32, 134/40, 122 R

[56] References Cited

U.S. PATENT DOCUMENTS 3,572,352 3/1971 Koopman ..... 134/122 R 4,064,884 12/1977 Asp ..... 134/122 R

FOREIGN PATENT DOCUMENTS 1533846 11/1974 United Kingdom .

*Primary Examiner*—Richard V. Fisher
*Assistant Examiner*—Sharon T. Cohen
*Attorney, Agent, or Firm*—C. O. Marshall, Jr.

[57] ABSTRACT

The invention provides for surface cleaning of wire rod and the like by holding the wire under tension while passed through a die system and vibrating the wire transversely so that it is abraded by the die surface. Cleaning liquid flushes the die bore.

4 Claims, 1 Drawing Figure

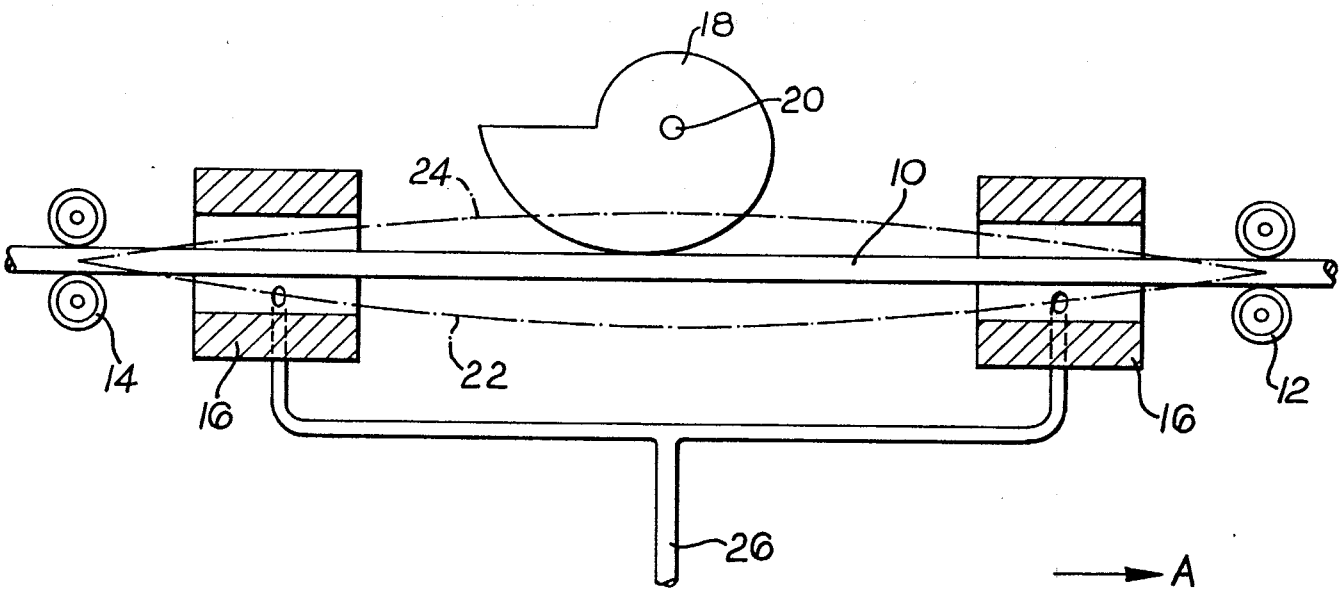
12
16
A
10
20
18
26
22
24
16
14

CLEANING ELONGATE STRIP BY DIE IMPACTION

This invention relates to cleaning wire and the like and in particular to the cleaning by abrasion of the surface of metal wire, rod or strip so as to remove for example oxide following a heat treatment operation, or lubricant following a rolling or drawing operation.

According to the invention a method of cleaning an elongate strip comprises passing the same through a die dimensioned to provide a working clearance about the strip and between it and the die, holding the strip under tension whilst so passed, causing transverse vibration of the strip relative to the die so that a number of points around the surface of the strip contact the die, and passing a fluid through the die to displace material removed from the strip surface by the die.

The invention also consists in apparatus for carrying out the method.

Where the strip consists of circular cross section wire, the die will have a cylindrical bore, and the same bore will be used as a passage for the fluid which is to displace material removed from the strip surface, and the fluid, which conveniently is water, may be pumped under pressure through a tangential opening to a mid-point along the length of the bore so that the water tends to spiral in opposite directions to the ends of the bore.

The strip may be vibrated transversely by mechanical means or by electromagnetic means for example. The vibrations may be applied to the strip whilst passing through a relatively stationary die structure, or alternatively the die structure may be subject to the vibrations so as to displace the strip laterally and hence cause the vibration in the strip.

In the case of mechanical vibration applied directly to the strip and using a static die structure, the wire may pass over a rotating pulley having it surface formed somewhat as a snail cam so that the wire is displaced laterally and then allowed to return due to the tension in the wire. A number of such means for causing the lateral displacement may be provided arranged for displacement generally at right angles to one another.

The preferred direction of vibration of the strip is in a generally circular pattern extending about the axis of the tensioned strip when not subject to the vibration.

Preferably a number of cleaning dies are provided, at suitable intervals, along the length of the strip and where mechanical or electromagnetic means cause the lateral movement of the wire, the force causing the vibration may be applied at points between successive dies so that the dies tend to act as nodes or at least as points of minimum amplitude of vibration with the maximum amplitude being at the points of application of the force causing the vibration.

Where electromagnetic forces are used, a rotating magnetic field may be set up for example at each die, and it is believed that this may be useful not only with magnetic materials as the strip but also with good electrical conductors as strip, and hence in practice with substantially all metal strips which are required to be cleaned.

The invention is applicable to strips which are not of circular cross section, for example rectangular strips. In this case the die will also be of similar rectangular section.

The dies may be made of a material selected according to the nature of the cleaning operation to be carried out, and according to the nature of the strip material. Thus, for example, cleaning oil from a soft material wire may be achieved using a high density polyethylene for the die, but if a fierce abrasive action is required to remove stubborn scale, a tungsten carbide material may be used for the die surface.

It is found experimentally that using a single die head with a circular bore, and an appropriate circular cross section wire passed at a high speed under tension through the bore, and caused to vibrate between the tension points which are located at a distance in front of and behind the die along the length of the feed direction, with a vibratory pattern such that if the die were not present the wire would vibrate in a generally circular fashion with the diameter of the circle being substantially larger than the die, then a cleaned track extends generally spirally along the length of the wire as a result of contact between the wire surface and the die bore. This in general is what is meant by "a number of points around the surface of the strip" having contacted the die and become cleaned. Such a result may be useful in certain circumstances, but usually it is required to clean the complete surface area of the strip and this requires adjustment of a number of parameters including the amplitude and possible also frequency of vibration, feed tension and speed (and feed tension itself affects the vibratory mode) and the number of dies used. However, the net result enables complete cleaning to be achieved with relatively low pressure and volume fluid flows.

The term "cleaning" can include removal of contaminants such as the lubricating oil mentioned, removal of surface oxide, and also include the possibility of including polishing or other surface finishing of the strip material with such removal of lubricants, scale and the like, or if the wire was chemically clean before the treatment, (which is an unusual situation) then it includes the possibility of performing a surface finishing or polishing operation per se.

In the accompanying drawing the sole FIGURE represents diagrammatically one possible apparatus for carrying out the invention.

In the drawing, the rod or strip 10 is conveyed in the direction of the arrow A under tension. For example it may be driven by pairs of pinch feed rolls 12 and 14 of which the rolls 12 run slightly faster than the rolls 14.

The rod passes through two cleaning dies 16 which are generally similar to one another, each of which has a bore slightly larger than the rod and of the same cross section. The drawing exaggerates the clearance in the interest of clarity in explaining the working of the invention.

In this example the rod is vibrated transversely and generally in a plane containing the axis of the rod by the use of a snail cam 18 which is rotated about the axis 20 and which engages the rod at its periphery substantially midway between the dies. This causes the rod to oscillate generally between the two extreme paths indicated by the chain dot lines 22 24, the oscillations being confined between nodal points at the respective pinch rolls 12 and 14 and being limited by the dies.

In practice, by using bores through the dies which are only slightly larger than the cross sectional dimensions of the rod, and a high frequency of vibration, substantially the entire periphery of the rod 10 can be cleaned.

By imparting vibration about a second axis at right angles to that of shaft 20, the rod can be caused to vibrate in a generally circular pattern within the bounds indicated by the chain dot lines 22 24 with increased certainty of cleaning of the entire surface area.

Material abraded from the rod surface in the dies is flushed by liquid pumped through the pipe system 26 and, in this embodiment, the pipes lead to tangential apertures in the die bores so as to cause a spiralling current of cleaning liquid to flow through the bores.

The rod may be dried for example by an air wipe constructed generally as described in British Pat. No. 1533846.

What is claimed is:

1. A method of cleaning an elongate strip while passing the strip through a die which surrounds and is spaced from the strip, by producing repeated lateral impacts between the strip and the surrounding die, comprising the steps of holding the strip under tension on both sides of the die while causing relative lateral vibration of the strip and the die, the amplitude of the vibration being sufficient to produce repeated lateral impacts between the strip and the surrounding die, and displacing material removed by such impacts, by passing a fluid through the die.

2. A method as claimed in claim 1 wherein the strip is vibrated and the die remains stationary.

3. A method as claimed in claim 2 wherein the strip is vibrated mechanically.

4. A method as claimed in claim 2 wherein the strip is vibrated electromagnetically.

* * * * *